United States Patent [19]

Ohlund et al.

[11] 4,119,317

[45] Oct. 10, 1978

[54] TARGET RAISING DEVICE WITH CURVED SUPPORTING RUNNERS

[75] Inventors: Ingvar Ohlund, Huskvarna; Hans Robertson, Jonkoping, both of Sweden

[73] Assignee: Saab-Scania Aktiebolag, Jonkoping, Sweden

[21] Appl. No.: 771,747

[22] Filed: Feb. 24, 1977

[30] Foreign Application Priority Data

Feb. 24, 1976 [SE] Sweden ..... 7602192

[51] Int. Cl.[2] ..... F41J 1/10; F41J 1/20

[52] U.S. Cl. ..... 273/105.6

[58] Field of Search ..... 273/105.6, 105.2, 102 S

[56] References Cited

U.S. PATENT DOCUMENTS

| | | | |
|---|---|---|---|
| 3,097,848 | 7/1963 | Massa | 273/105.6 |
| 3,233,904 | 2/1966 | Gillam et al. | 273/102 S |
| 3,733,073 | 5/1973 | Gutler | 273/105.6 |

FOREIGN PATENT DOCUMENTS

| | | | |
|---|---|---|---|
| 1,118,015 | 6/1968 | United Kingdom | 273/105.6 |

*Primary Examiner*—Richard C. Pinkham
*Assistant Examiner*—L. E. Anderson
*Attorney, Agent, or Firm*—Fleit & Jacobson

[57] ABSTRACT

A target raising device for shooting practice having a target mountable on a transverse shaft rotatable by a motor, and containing a power unit, such as a battery, for driving the motor and a control unit, such as a radio receiver, for remote control of the motor, wherein the target raising device is supported by runners which are arranged along each longitudinal side of the device and which are curved up at the front and rear ends, and are curved back at the top to form carrying handles, whereby the position of the transverse shaft is close to the center of the curved parts of the runners at one end of the target raising device, so that as the target is raised or lowered rods which support the target and which are attached to the transverse shaft at right angles to it pass by the last named curved parts of the runners approximately at right angles to tangents of the curved parts, so that an object or part of a body accidentally interposed between the rods and the curved parts of the runners is carried along by the rod without interferring or jamming.

3 Claims, 6 Drawing Figures

TARGET RAISING DEVICE WITH CURVED SUPPORTING RUNNERS

The present invention relates to a target raising device for shooting practice, and in particular to a target raising device having a target mountable on a transverse shaft rotatable by a motor and containing a power unit, such as a battery, for driving the motor and also a control unit, such as a radio receiver, for receiving control impulses from a remote radio transmitter for controlling the motor.

The present invention provides a target raising device for shooting practice, comprising a target mountable on a transverse shaft rotatable by a motor, a power unit for driving the motor, and a control unit for remote control of the motor, wherein the target raising device is supported by runners which are arranged along each longitudinal side of the device and which are curved up and back at the front and rear ends to form carrying handles, whereby the position of the transverse shaft is close to the centre of the curved parts of the runners at one end of the target raising device, so that as the target is raised or lowered rods which support the target and which are attached to the transverse shaft at right angles to it pass by the said curved parts of the runners approximately at right angles to tangents of the said curved parts.

The target raising device according to the invention is portable, and moreover may be towed along a supporting surface. The device is also designed such that raising and lowering a target may take place without risk of damage by jamming or crossing. In addition two or more target such raising devices may be stacked on one another for transport. Furthermore, the target raising device may be constructed to be low in height, so that it may be easily shielded from direct firing behind a protective bank.

The invention will be further described by way of example only, with reference to the accompanying drawings, in which.

Figure 2:
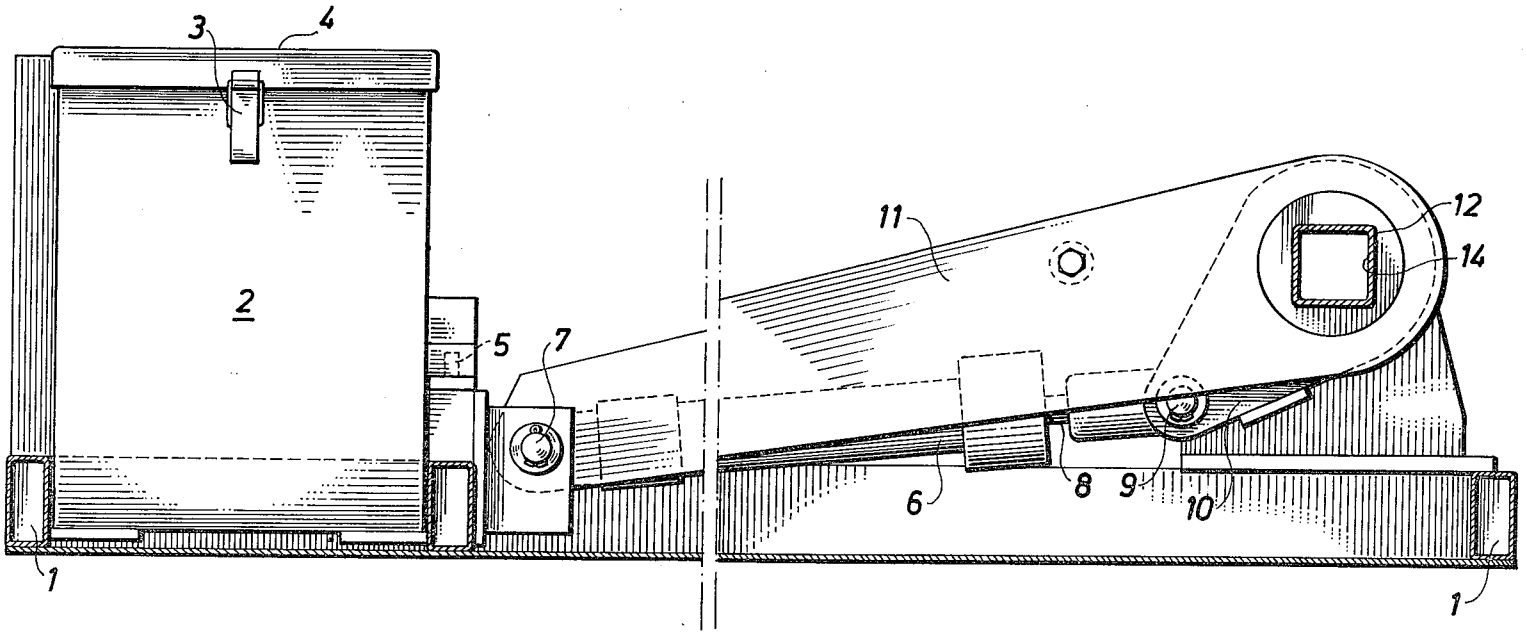
FIG. 2 is an elevational side view of the inside of the target raising device showing the power unit together with the motor for raising the target.
Figure 3:
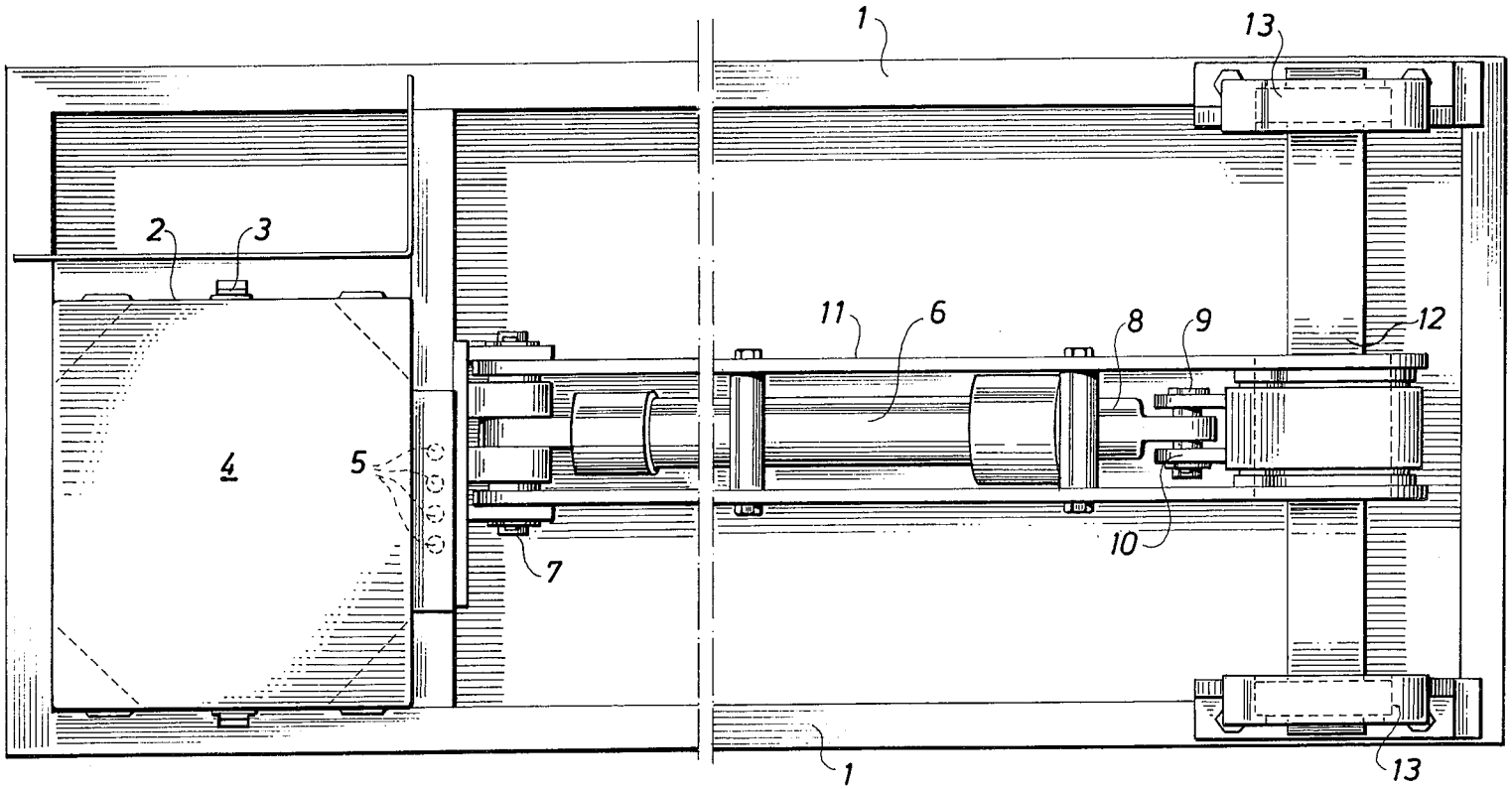
FIG. 3 is a corresponding top view of the component parts shown in FIG. 2.

The target raising device shown in the drawings houses inside a frame 1 a power unit 2 containing a replaceable electric battery, which is retained by a cover 4 held by means of clips 3. A contact device 5 is provided for connecting the battery to a motor (not shown) for driving an hydraulic pump (also not shown) which feeds pressure oil to an hydraulic cylinder 6. The left end of the hydraulic cylinder in FIGS. 2 and 3 is attached by a pin 7 to the frame 1, and its piston rod 8 is connected by means of a pin 9 to a linkage 10 attached to a transverse shaft 12 rotatably mounted in a part of a frame 11. The linkage allows the hydraulic cylinder to turn the transverse shaft back and forth through an angle of approximately 90°. A bearing 13 is provided in the frame 1 for the transverse shaft.

Figure 1:
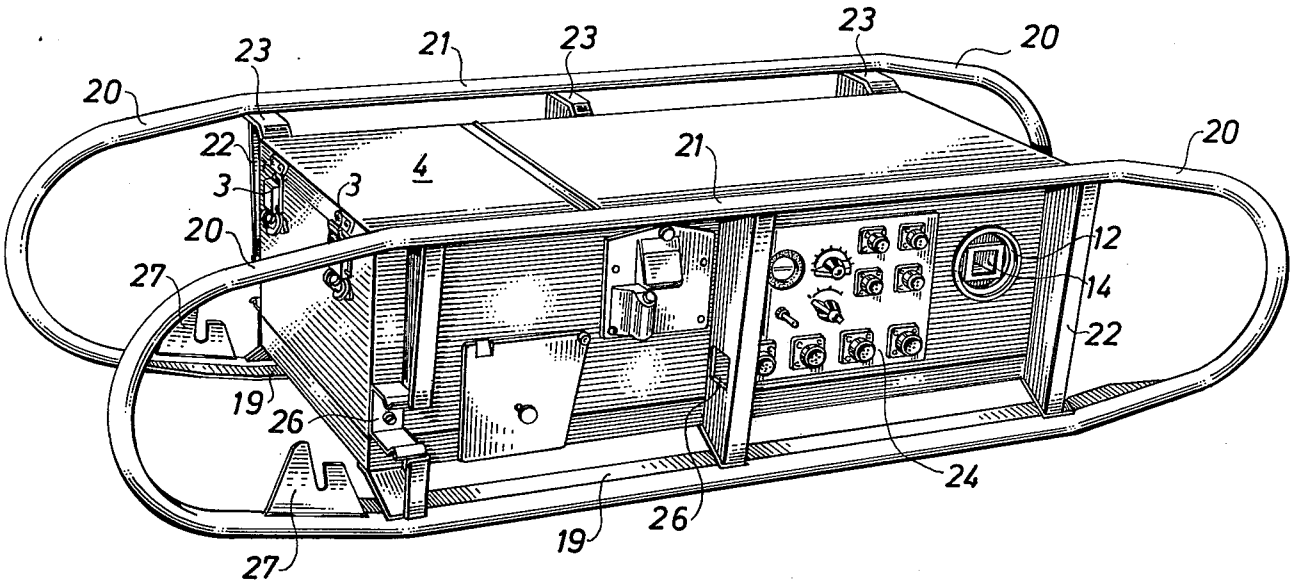
FIG. 1 is a perspective view of a target raising device according to the invention shown without targets.
Figure 4:
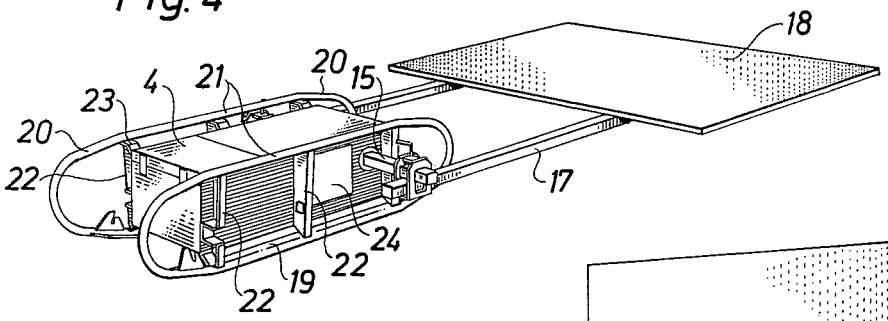
FIG. 4 is a perspective view of the target lowering device with a lowered target.
Figure 5:
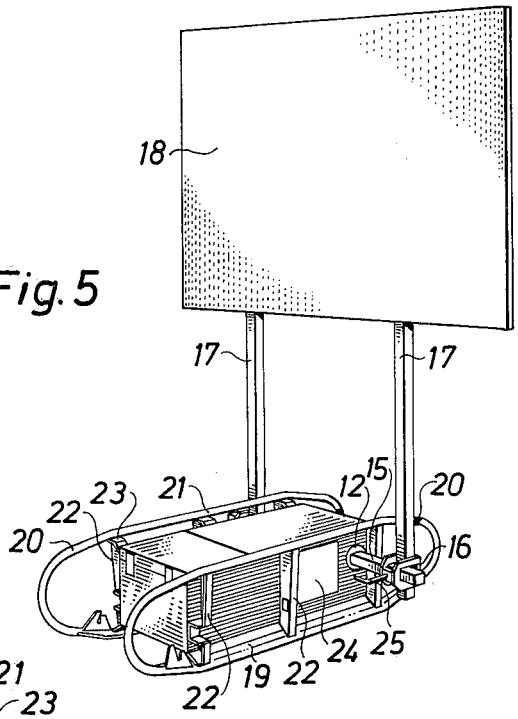
FIG. 5 is a view similar to FIG. 4 but of the device with a raised target.

As shown in FIGS. 1 and 2, the transverse shaft 12 has a square through hole 14, and is adapted to receive an extension shaft 15 as shown in FIGS. 4 and 5 having a corresponding square cross section. By means of holders 16 rods 17 may be attached perpendicular to the extension shaft, the rods 17 supporting a target board 18 or other target for shooting practice.

The target raising device is supported by runners 19 arranged along each longitudinal side, which runners are curved up and back at the front and rear ends to form carrying handles 20, the position of the transverse shaft 12 being close to the centre of the curved parts 20 of the runners at one end of the target raising device. Thus as the target is raised or lowered the rods 17, which support the target 18 and are attached to the transverse shaft at right angles to it, move past the curved parts 20 of the runners 19 at an angle of between approximately 60° and almost 90° to tangents of the curved parts such that an object or part of a body accidentally interposed between the rods 17 and the curved parts of the runners is carried along by the rod without interferring or jamming.

Figure 6:
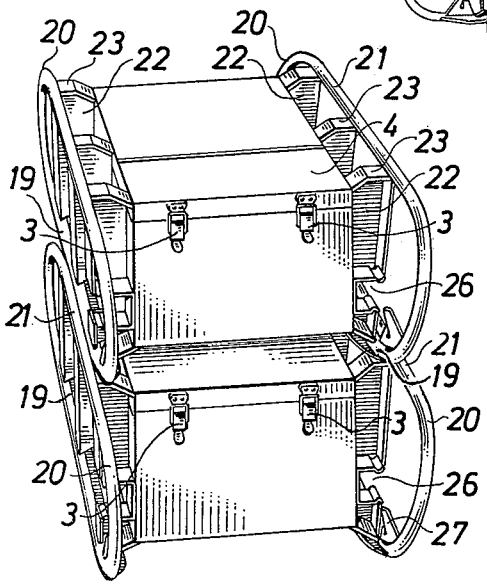
FIG. 6 shows a pair of target raising device stacked on one another.

The parts curved back at the top of either runner 19 may be joined to one another by means of straight members 21. As shown in FIG. 6 the planes containing the runners slightly slope upwards away from one another, so that the lower parts 19 of the runners may, when two or more target raising devices are stacked on one another, be positioned inside the upper parts 21 of the runners of a lower target raising device. It is best to attach the runners to struts 22 fitted vertically to the frame 1, whereby the upper ends 23 of the struts provide support for an upper target raising device placed on a lower target raising device.

When the target raising device is used, it is best to conceal it behind a protective wall (not shown) so as to avoid direct hits on the target raising device. Raising of the target is controlled by means of a radio receiver 24, which receives control signals from a radio transmitter located for example by the firing line.

As shown in FIGS. 4 and 5, it is best to fix the rods 17 on the front of the extension shaft 15, whereby in the lowered position of the target 18 shown in FIG. 4 the rods come closer to the ground than if the rods were fixed to the other side of the extension shaft.

In order that the extension shaft 15 be always inserted into the transverse shaft 12 in the same rotation position, the extension shaft may have on one side a longitudinal groove (not shown) matching a rib (not shown) formed in the square hole 14.

Each holder 16 has an attachment screw 25, by means of which the holder may be tightened and grip its rod 17. A protective plate (not shown) on the holder can prevent the rod from being inserted on the wrong side of the extension shaft.

When the target raising device is transported the holder 16 is released so that the rods 17 with the target 18 may be removed. In order to reduce the width of the device, the extension shaft 15 is then pulled out of the transverse shaft 12. The shaft 15 may be kept in the longitudinal direction of the target raising device by being inserted into square holes or attachments 26 in the struts. The holder 16 that goes on the extension shaft is tightened and the free end of its attachment screw 25 is inserted into a clip 27, which prevents the extension shaft being inadvertently moved in its longitudinal direction.

As the parts 20 of the runners acting as carrying handles have a convenient slope at the front and back respectively, both the person carrying at its front end as well as the person carrying at its back end may take a correct hold of the carrying handles. The target raising device may be carried either by one person at its front end and another at its back end or by two persons at the front end and one or two at the back end. The runners facilitate loading of the target raising device onto a lorry, for example the target raising device may be pushed up over the edge of the platform of the lorry.

It will be appreciated that the power unit may be fitted for direct mains connection and raising the target may be controlled by a method other than by radio.

We claim:

1. A target raising device for shooting practice, comprising a target mountable on a transverse shaft rotatable by a motor, a power unit for driving the motor, and a control unit for remote control of the motor, wherein the target raising device is supported by runners which are arranged along each longitudinal side of the device and which are curved up and back at the front and rear ends to form carrying handles, the mass and shape of the target raising device being such that the target raising device may be bodily moved by at least one person when grasping said handles, rods supporting said target pivoting in a plane of movement adjacent the runners, whereby the position of the transverse shaft is substantially at the centre of curvature of the curved parts of the runners at one end of the target raising device, so that as the target is raised or lowered said rods which support the target and which are attached to the transverse shaft at right angles to it pass by the said curved parts of the runners approximately at right angles to tangents of the said curved parts.

2. A target raising device according to claim 1, wherein the power unit is a battery.

3. A target raising device according to claim 1, wherein the control unit is a radio receiver.

* * * * *